US010940966B2

(12) United States Patent
Pereira

(10) Patent No.: US 10,940,966 B2
(45) Date of Patent: Mar. 9, 2021

(54) MACHINE AND METHOD FOR PRODUCING CUSHIONING MATERIAL

(71) Applicant: Storopack Hans Reichenecker GMBH, Metzingen (DE)

(72) Inventor: Vicentina Pereira, Sao Paulo (BR)

(73) Assignee: Storopack Hans Reichenecker GMBH, Metzingen (DE)

( * ) Notice: Subject to any disclaimer, the term of this patent is extended or adjusted under 35 U.S.C. 154(b) by 0 days.

(21) Appl. No.: 16/976,901

(22) PCT Filed: Jan. 23, 2019

(86) PCT No.: PCT/EP2019/051538

§ 371 (c)(1),
(2) Date: Aug. 31, 2020

(87) PCT Pub. No.: WO2019/166158

PCT Pub. Date: Sep. 6, 2019

(65) Prior Publication Data

US 2021/0002011 A1 Jan. 7, 2021

(30) Foreign Application Priority Data

Mar. 1, 2018 (EP) ..... 18159584

(51) Int. Cl.
*B65B 41/12* (2006.01)
*B65B 31/04* (2006.01)
(Continued)

(52) U.S. Cl.
CPC ..... *B65B 31/048* (2013.01); *B65B 7/164* (2013.01); *B65B 9/042* (2013.01);
(Continued)

(58) Field of Classification Search
CPC ..... B65B 31/048; B65B 31/04; B65B 31/046; B65B 9/024; B65B 9/08; B65B 7/164;
(Continued)

(56) References Cited

U.S. PATENT DOCUMENTS 4,417,607 A * 11/1983 Scholle ..... B65B 55/022 134/134
5,658,228 A 8/1997 Van de Geijn et al.
(Continued)

FOREIGN PATENT DOCUMENTS

EP 1323519 A2 7/2003
EP 1616693 A2 1/2006

OTHER PUBLICATIONS

PCT/EP2019/051538, International Search Report and Written Opinion, dated Mar. 15, 2019.

*Primary Examiner* — Nicolas A Arnett
(74) *Attorney, Agent, or Firm* — Wood Herron & Evans LLP

(57) ABSTRACT

A machine for producing cushioning material comprises: a frame; at least a first supply assembly preferably mounted on said frame, the first supply assembly supplying a first web-type feed material; and at least a first transformation assembly mounted on said frame which transforms the first web-type feed material into a first cushioning material. It is suggested that it further comprises: at least a second supply assembly preferably mounted on said frame, the second supply assembly supplying a second web-type feed material; and at least a second transformation assembly mounted on said frame which transforms the second web-type feed material into a second cushioning material.

14 Claims, 3 Drawing Sheets

(51) Int. Cl.
*B65B 9/04* (2006.01)
*B65B 7/16* (2006.01)
*B65B 41/18* (2006.01)

(52) U.S. Cl.
CPC ..... *B31D 2205/0082* (2013.01); *B31D 2205/0088* (2013.01); *B65B 41/12* (2013.01); *B65B 41/18* (2013.01)

(58) Field of Classification Search
CPC . B65B 41/12; B65B 41/18; B31D 2205/0082; B31D 2205/0088
See application file for complete search history.

(56) References Cited

U.S. PATENT DOCUMENTS 5,658,229 A * 8/1997 Armington ..... B26D 1/30 493/363
5,942,076 A * 8/1999 Salerno ..... B31D 5/0073 156/147
6,131,375 A * 10/2000 Sperry ..... B29C 44/182 53/472
6,213,167 B1 * 4/2001 Greenland ..... B31D 5/0073 141/1
6,582,800 B2 * 6/2003 Fuss ..... B29C 66/133 428/178
6,598,373 B2 * 7/2003 Sperry ..... B31D 5/0073 53/403
6,804,933 B2 * 10/2004 Sperry ..... B31D 5/0073 156/145
6,862,868 B2 * 3/2005 Sperry ..... B29C 44/183 53/127
6,952,910 B1 * 10/2005 Lorsch ..... B29C 66/8322 53/472
7,273,142 B2 * 9/2007 Huis ..... B31D 5/0073 198/369.2
7,914,239 B2 * 3/2011 Van Huis ..... B31D 5/0073 406/88
8,020,358 B2 * 9/2011 Sperry ..... B29C 66/8181 53/403
8,056,598 B2 * 11/2011 Chiang ..... B29C 65/229 156/497
8,061,110 B2 * 11/2011 Wetsch ..... B31D 5/0073 53/79
8,240,533 B2 * 8/2012 Wetsch ..... B65B 55/20 225/93
8,635,836 B2 * 1/2014 Tan ..... B29C 65/223 53/79
9,340,311 B2 * 5/2016 Sperry ..... B29C 65/02
9,688,044 B2 * 6/2017 Deis ..... B65D 81/127
10,286,617 B2 * 5/2019 Murch ..... B31D 5/0073
2006/0289108 A1 * 12/2006 McNamara, Jr. .... B65H 23/032 156/147
2007/0011989 A1 1/2007 Sperry et al.
2007/0068353 A1 * 3/2007 Piucci ..... B65H 35/008 83/311
2007/0251190 A1 11/2007 Daigle et al.
2009/0082187 A1 * 3/2009 Cheich ..... B65D 81/03 493/350
2010/0251668 A1 * 10/2010 Sperry ..... B65B 31/06 53/403
2019/0283912 A1 * 9/2019 Wetsch ..... B31D 5/0073
2019/0291907 A1 * 9/2019 Wetsch ..... B29C 66/0044

* cited by examiner

MACHINE AND METHOD FOR PRODUCING CUSHIONING MATERIAL

This invention relates generally to a machine and a method for producing cushioning material according to the preambles of the independent claims.

It is well known from the market to use cushioning material for providing a cushioning effect to products which are shipped within a container. The cushioning material can be formed by crumbled paper, loose fill material in the form of plastic peanuts, air bags, bubble films, and the like. International patent publication WO 00/27619 A1 discloses a cushioning product and a machine and a method for producing the same. The disclosed machine produces pillow-type air bags from a web-type feed material.

It has been recognized that there is a need to provide a machine and a method for producing cushioning material offering an increased flexibility during use. It is therefore an object of the present invention to provide a machine and a method which responds to this need.

The invention therefore proposes a machine for producing cushioning material which comprises a frame. The term "frame" in this context is to be understood broadly in the sense of any structure which mechanically supports other elements and assemblies. It can be made of metal or plastic or can combine both elements of matter and of plastic. It may comprise a portion providing a support on a floor or on a table, but it may also comprises a portion providing a support on a wall.

The inventive machine also comprises at least a first supply assembly preferably mounted on said frame, the first supply assembly supplying a first web-type feed material. The web-type feed material may be a material which is prefabricated at another location, or may be a material which is prefabricated within the machine on the basis of a raw feed material. It may be made of any type of material, such as paper, plastic, biodegradable, and the like.

Furthermore, the inventive machine comprises at least a first transformation assembly mounted on said frame which transforms the first web-type feed material into a first cushioning material. Such a transformation assembly may be of any suitable type which transforms a web-type feed material into a cushioning material providing a cushioning characteristic as required for cushioning a product to be shipped in a container. Examples for such a transformation assembly are an assembly producing crumbled paper pads and an assembly producing air bags or air pillows and an assembly producing bags filled with a foam material. Such transformation assemblies are generally well known to a person skilled in the art.

The present invention specifically proposes that the inventive machine further comprises at least a second supply assembly preferably mounted on said frame, the second supply assembly supplying a second web-type feed material; and at least a second transformation assembly mounted on said frame which transforms the second web-type feed material into a second cushioning material.

By consequence, the same frame of one single machine preferably supports at least two separate supply assemblies and and supports two separate transformation assemblies and thus allows for the production of two separate cushioning materials. This provides a considerably increased flexibility to a user of the inventive machine. For example, the increased flexibility can be used to increase the output of cushioning material at a single packaging position, or can be used to output cushioning material at two adjacent packaging positions.

In a preferred embodiment of the invention the first web-type feed material is different than the second web-type feed material. The advantage of this embodiment is that with one single machine at least two different types of cushioning material can be produced such that a user can choose that cushioning material which is best suited for a specific packaging scenario. The cushioning and packaging quality, respectively, thus can be enhanced.

In yet another embodiment of the invention the first and second web-type feed materials are plastic film materials having inflatable chambers, wherein at least one of the geometry and the dimension of the inflatable chambers of the second web-type feed material is different than the geometry and dimension of the inflatable chambers of the first web-type feed material. In an application where for some reason an air bag or air bubble type cushioning material is to be used, this embodiment again provides for the possibility to specifically select a cushioning material which is best suited for a specific packaging scenario.

In yet another embodiment the first transformation assembly comprises at least a first inflation assembly for inflating the chambers within the first web-type feed material; at least a first sealing assembly for sealing the inflated chambers after inflation; and at least a first feed assembly mounted on said frame which feeds the first web-type feed material from the first supply assembly to the first inflation assembly and the first sealing assembly; and wherein the second transformation assembly comprises at least a second inflation assembly for inflating the chambers within the second web-type feed material; at least a second sealing assembly for sealing the inflated chambers after inflation; and at least a second feed assembly mounted on said frame which feeds the second web-type feed material from the second supply assembly to the second inflation assembly and the second sealing assembly. This provides for a maximum flexibility, because each transformation assembly is fully autonomous.

In yet another embodiment the first transformation assembly is arranged on a first side of the frame and the second transformation assembly is arranged on a second side of the frame, the first and second sides being opposite with respect to each other. Such a machine is statically stable and allows to be used by one single user at one single packaging station as well as to be used by two users at two adjacent packaging stations.

In yet another embodiment of the invention the first transformation assembly is arranged such that the first cushioning material is dispensed in a first direction and the second transformation assembly is arranged such that the second cushioning material is dispensed in a second direction, the first and second directions being opposite with respect to each other. This embodiment is particularly advantageous if the machine is to be used by two separate users at two adjacent packaging stations.

In yet another embodiment of the invention the machine comprises a selection means for selecting at least one of a first mode and a second mode, wherein in the first mode the first transformation assembly can be activated, and wherein in the second mode the second transformation assembly can be activated. The proposed selection means allows first to select which one of the first and second transformation assemblies shall be used, and then, for example by means of a separate control means such as a control button or a foot switch, to activate the respective transformation assembly in order to produce an amount of the selected type of cushioning material.

In yet another embodiment the machine comprises a controlling means which in a first mode controls operation of the first transformation assembly, and which in a second mode controls operation of the second transformation assembly. The advantage of this embodiment is that costs are reduced, because the first and second transformation assemblies are controlled by a common controlling means.

In yet another embodiment the machine comprises means for setting an amount of cushioning material to be produced upon an activation in the first mode and in the second mode. This allows to produce in each mode of operation an appropriate amount of cushioning material, this amount for example being adapted to the type of cushioning material which is produced upon activation of the respective transformation assembly.

For example, it is possible that the amount in the first mode is different than the amount in the second mode.

In yet another embodiment of the present invention comprising inflation means the first and the second inflation means comprise a common air blower. This reduces manufacturing and operation costs.

In yet another embodiment each of the first and second transformation assemblies comprises a controlling means for controlling operation of the respective first and second transformation assemblies. This again increases the flexibility of the inventive machine, because the transformation assemblies can be operated and controlled entirely separately. As an example, each of the controlling means may comprise one or more control buttons and/or one or more foot switches in order to allow to separately activate and stop each of the transformation assemblies.

In yet another embodiment of the present invention the first and/or the second web-type feed material comprises portions which are connected to each other by a perforation line. Such a perforation line helps to separate pads from the produced web-type cushioning material and therefore eases the provision of cushioning material of an appropriate size.

In yet another embodiment of the present invention at least one of the first supply assembly and the second supply assembly comprises holding means for holding a roll of feed material. Such a roll of feed material can be easily produced and is therefore relatively cheap.

In yet another embodiment of the present invention at least one of the first supply assembly and the second supply assembly comprises storage means for storing a zig-zag-folded feed material. Such a storage means may for example be formed by the simple box. This allows to store a greater amount of feed material, especially in the case of a plurality of connected storage means being provided.

A method of producing cushioning material comprises: providing at least a first supply assembly mounted on a frame, the first supply assembly supplying a first web-type feed material; providing at least a second supply assembly mounted on said frame, the second supply assembly supplying a second web-type feed material; and selecting whether the cushioning material shall be produced using the first supply assembly or whether the cushioning material shall be produced using the second supply assembly.

In yet another embodiment of the inventive method the method comprises providing a second web-type feed material being different than the first web-type feed material.

Other features and advantages of the invention will become apparent from the following detailed description. It is to be understood that the same reference signs will be used in different embodiments for those elements and regions having equivalent functional characteristics. Also, subsequent embodiments generally will be described only with respect to differences to preceding embodiments. This means that any variations which have been mentioned with respect to a preceding embodiment may also apply to one or more of the subsequent embodiments.

Figure 1:
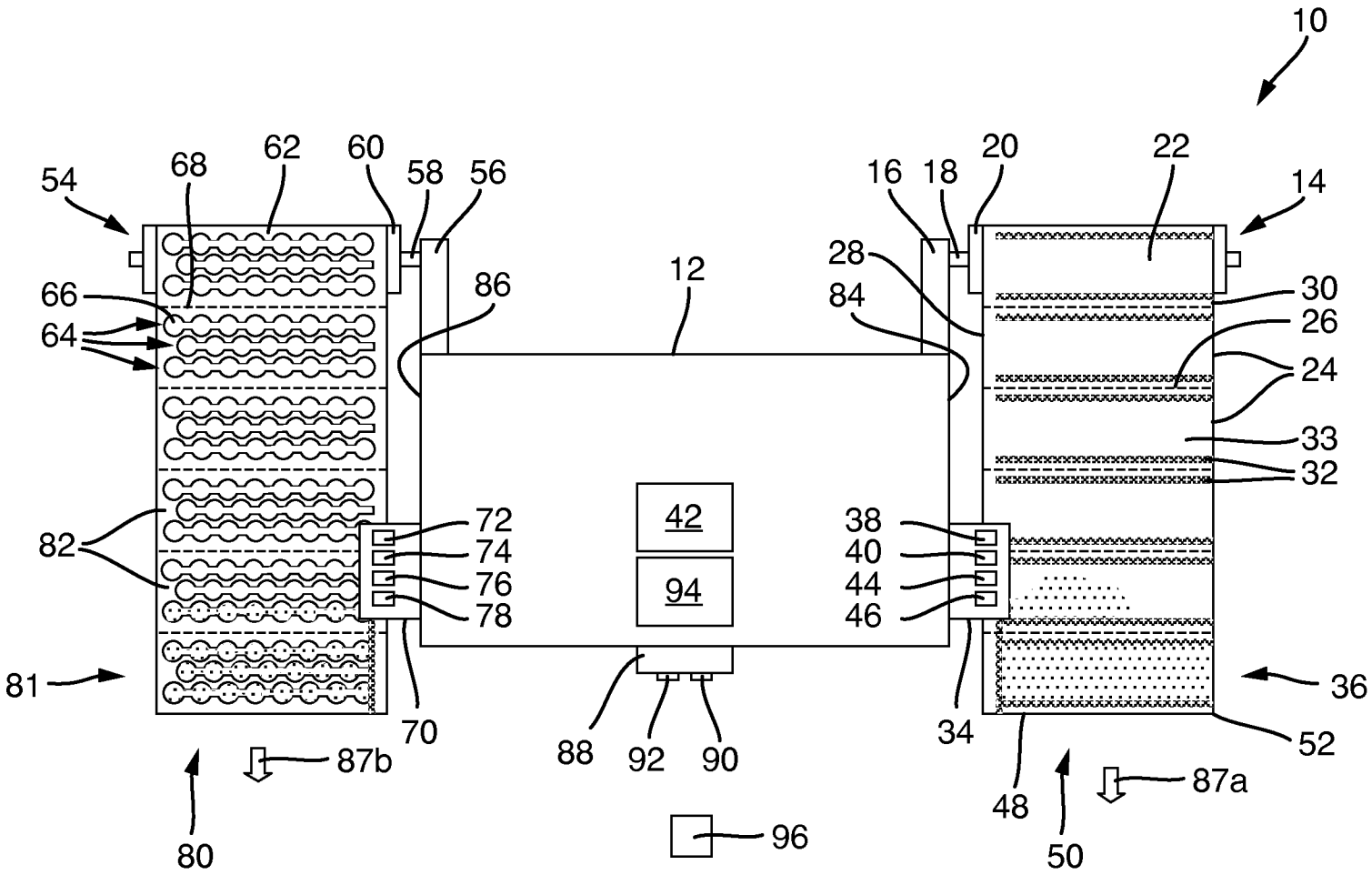
FIG. 1 is an overall schematic view from above on a first embodiment of a machine for producing cushioning material.

Referring now to FIG. 1, a machine 10 for producing cushioning material comprises a frame 12. While in FIG. 1 the frame 12 is shown only as a rectangular box, it is readily understood by the skilled person that it may comprise any mechanical structure which mechanically supports other elements and assemblies. Such a mechanical structure can be made of metal or plastic or can combine both elements of metal and of plastic. It may be formed by a number of struts and the like, and/or may comprise a box-type housing which supports and/or encases electrical and mechanical components of the machine 10.

The machine 10 also comprises a first supply assembly 14 which comprises a holding arm 16 and a shaft 18, the holding arm 16 supporting the shaft 18 and being connected to the frame 12. The first supply assembly 14 therefore is mounted on the frame 12. The shaft 18 holds a roll 20 of a first feed material 22. The first feed material 22 is a web-type feed material. Portions 24 of the first web-type feed material 22 are linked together by perforations 26 and allow to easily separate portions of the produced cushioning material from the remainder. It is to be understood that also other types of regions having a reduced material strength might be provided in order to allow an easy separation of portions 24 by a user.

The first web-type feed material 22 is formed as a tube, which means that lateral side edges 28 and 30 which extend in longitudinal direction of the first web-type feed material 22 are closed. On both sides of each perforation 26 are provided two transverse seals 32 which have been formed by welding. By consequence, between two transverse seals 32 and the lateral side edges 28 and 30 a pocket type chamber 33 is formed, which in the first web-type feed material 22 is void, but which later will be inflated by air, as will be explained in detail further below, in order to form a desired cushioning material.

In the present embodiment, the first web-type feed material 22 is a prefabricated material, which has been prefabricated at another location, for example at the location of a specific supplier. In another embodiment which is not shown the first web-type feed material may be prefabricated within the machine on the basis of a raw feed material. Theoretically, the web-type feed material may be made of any type of material, such as paper, plastic, biodegradable, and the like. However, in the present case, the first web-type feed material 22 is made of a thin plastic film formed to a closed longitudinal tube.

The machine 10 of FIG. 1 also comprises a first transformation assembly 34, which in FIG. 1 is only shown schematically as a box. The first transformation assembly 34 is mounted on said frame 12 and is provided in order to transform the first web-type feed material 22 into a first cushioning material 36. Generally speaking, the first transformation assembly 34 may be of any suitable type which transforms the first web-type feed material 22 into a desired first cushioning material 36 providing a cushioning characteristic as required for cushioning a product to be shipped in a container. In embodiments which are not shown such a transformation assembly may be an assembly producing crumpled paper pads or the like.

In the presently shown embodiment, the first transformation assembly 34 transforms the first web-type feed material 22 into a first cushioning material 36 consisting of inflated air bags. For this purpose, in the present embodiment, the first transformation assembly 34 by way of example comprises four different sub-assemblies: first, a first opening assembly 36 is provided for opening the lateral side edge 28. First opening assembly 36 may comprise, by way of example, a knife or the like.

Second, the first transformation assembly 34 comprises a first inflation assembly 40 for inflating the chambers 33 which are built within the first web-type feed material 22. The first inflation assembly 40 obtains pressurised air from a suitable source, in the present case from an air blower 42. It comprises a guiding pin (not shown), which extends parallel to side edge 28 and through the opening provided by first opening assembly 38 into the chambers 33. The guiding pin comprises an outlet for the pressurised air which allows inflation of that chamber 33 inside the first web-type feed material 22 which the guide pin presently is inserted in. In the drawing, those portions which are inflated by air are drawn as dotted areas.

Third, the first transformation assembly 34 comprises a first feed assembly 44. The feed assembly may be comprise two endless belts, one of which is driven in clockwise direction, and the other one is driven in counter-clockwise direction. Portions of each of the endless belts are pressed against each other, and a portion adjacent to the side edge 28 of the first web-type feed material 22 is clamped between these two portions. When both endless belts are driven, for example by an electric motor, the first web-type feed material 22 is pulled from the first supply assembly 14 through the first opening assembly 38 and the first inflation assembly 40, and is finally fed to a fourth assembly, namely a first sealing assembly 46.

The first sealing assembly 46 is provided for sealing the chambers 33 after being inflated by means of inflation assembly 40. Sealing assembly 46 provides a seal 48 in longitudinal direction, that is parallel and adjacent to the longitudinal side edge 28. In the present exemplary embodiment, a longitudinal seal 48 is provided by heat welding. Such a heat welding may be provided for example by heating that part of the above mentioned endless belts which act on the first web-type feed material 22.

At the end, at a first machine exit 50, the machine 10 provides a first cushioning material 36 in the form of bags 52 inflated with air, the portions of the bags 52 which are filled with air being delimited by the lateral side edge 30, two transverse seals 32 and longitudinal seal 46.

Adjacent air bags 52 are connected to each other by means of perforations 26, and therefore easily can be separated from each other by a user.

As can be seen from FIG. 1, the machine 10 of FIG. 1 comprises a second supply assembly 54, which is mounted on the frame 12 identically to the first supply assembly 14, that is by means of a holding arm 56. It comprises a shaft 58 to hold a roll 60 of a second web-type feed material 62.

The second web-type feed material 62 is different than the first web-type feed material 22. It does not comprise relatively large chambers, but rather comprises rows 64 of bubbles 66, the bubbles 66 of one row being connected with each other. The rows 64 of bubbles 66 extend transversely to the longitudinal direction of the second web-type feed material 62 and are delimited by sealed lines. By consequence, the bubbles 66 form chambers which have a geometry and dimension which is different than the geometry and dimension of the chambers 33 of the first web-type feed material 14. Again, portions of the second web-type feed material 62 are connected to each other by perforations 68.

As also can be seen from FIG. 1, the machine 10 of FIG. 1 comprises a second transformation assembly, which in principle is similar, if not identical to the first transformation assembly 34. This means that it it is also mounted on said frame 12 and comprises a second opening assembly 72, a second inflation assembly 74, a second feed assembly 76, and a second sealing assembly 78. The second transformation assembly 70 thus functions identically to the first transformation assembly 34. Therefore, for the sake of simplification, the functions are not explained in detail again.

At a second machine exit 80, the machine 10 provides a second type of cushioning material 81 in the form of pads 82 which comprise rows 64 of air filled bubbles 66. Adjacent pads 82 are connected to each other by means of perforations 68, and therefore easily can be separated from each other by a user.

As can be seen from FIG. 1, the first transformation assembly 34 is arranged on a first side 84 of the frame 12, and the second transformation assembly 70 is arranged on a second side 86 of the frame 12, wherein the first side 84 and the second side 86 being arranged opposite with respect to each other, that is on opposite sides of the frame 12. However, as is indicated by arrow is 87*a* and 87*b*, the first cushioning material 36 is dispensed at the first machine exit 50 in a first direction 87*a* and the second cushioning material 81 is dispensed at the second machine exit 80 in a second direction 87*b*, the first and second directions 87*a* and 87*b* being the same.

Referring again specifically to FIG. 1, there is provided only one single air blower 42. The reason is that this single air blower 42 provides pressurised air not only to the first inflation assembly 40 but also to the second inflation assembly 74.

Furthermore, machine 10 comprises a selection means 88 having a first button 90 and a second button 92. Selection means 88 is connected to a controlling means 94 which in a first mode controls operation of the first transformation assembly 34, and which in a second mode controls operation of the second transformation assembly 70. Selection means 88 allows to select between the first mode and the second mode. If a user pushes first button 90, the first mode is selected. If a user pushes second button 92, the second mode is selected.

Machine 10 also comprises a foot switch 96. Upon depression of foot switch 96, the machine produces a predetermined length either of the first cushioning material 36 or of the second cushioning material 81, depending on whether the first mode has been selected by pushing the first button 90 or whether the second mode has been selected by pushing the second button 92. As can be readily understood from FIG. 1, the machine 10 provides the possibility to a user to obtain two different cushioning materials 36 and 81 at a same packaging station. This allows a user to select specifically that cushioning material 36, 81 which is best suited for a specific packaging scenario.

It is readily understood by the skilled person that also other control device is than the foot switch 96 could be used to operate the transformation assemblies 34 and 70. For example, a button which is operated by hand could be used, or speech recognition or the recognition of gestures could be used. Also, by way of example, a touch pad could be used.

Not shown in the drawing, but also possible is that the machine, which is principally shown in FIG. 1, comprises two separate foot switches (or other control devices) which allow an independent operation of the first transformation assembly and the second transformation assembly by two independent users. By way of example, this would allow to provide separate packaging stations with cushioning material. Especially in such a case it is possible that the first web-type feed material and the second web-type feed material are identical, such that also the first cushioning material and the second cushioning material are identical.

It is to be understood that the length of first cushioning material 36 which is produced in the first mode may be different from the length of the second cushioning material 81 which is produced in the second mode. The machine 10 comprises input means (not shown), which allow a user to input the desired length for each mode.

Figure 2:
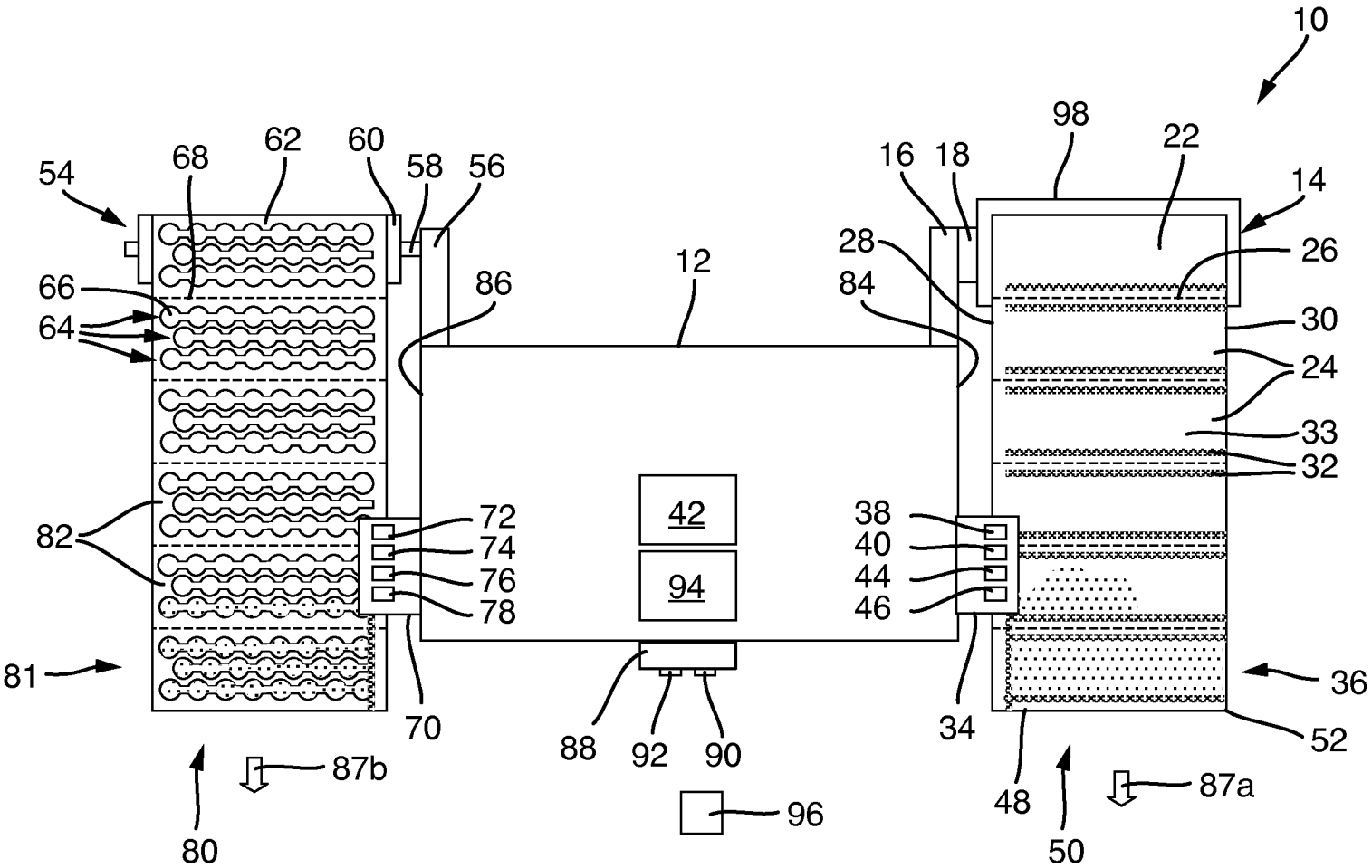
FIG. 2 is a view similar to FIG. 1 on a second embodiment of a machine for producing cushioning material.

Referring now to FIG. 2, which shows a second embodiment of a machine 10 for producing a cushioning material 36, 81, the difference with respect to FIG. 1 lies in the first supply assembly 14. Other than the first supply assembly 14 of the embodiment of FIG. 1, the first supply assembly 14 of the embodiment of FIG. 2 comprises a box 98 which in the embodiment shown in FIG. 2 is open to the above and which is mounted on frame 12 by means of a holding arm 16. However, in an embodiment which is not shown the box 98 may simply stand on a floor without being mounted to frame 12.

Box 98 serves as a storage means for storing a zig-zag-folded web-type feed material 22, which forms the first web-type feed material 22, which then in the first transformation assembly 34 is transformed into the first cushioning material 36, which is identical to the first cushioning material 36 of the embodiment of FIG. 1.

Figure 3:
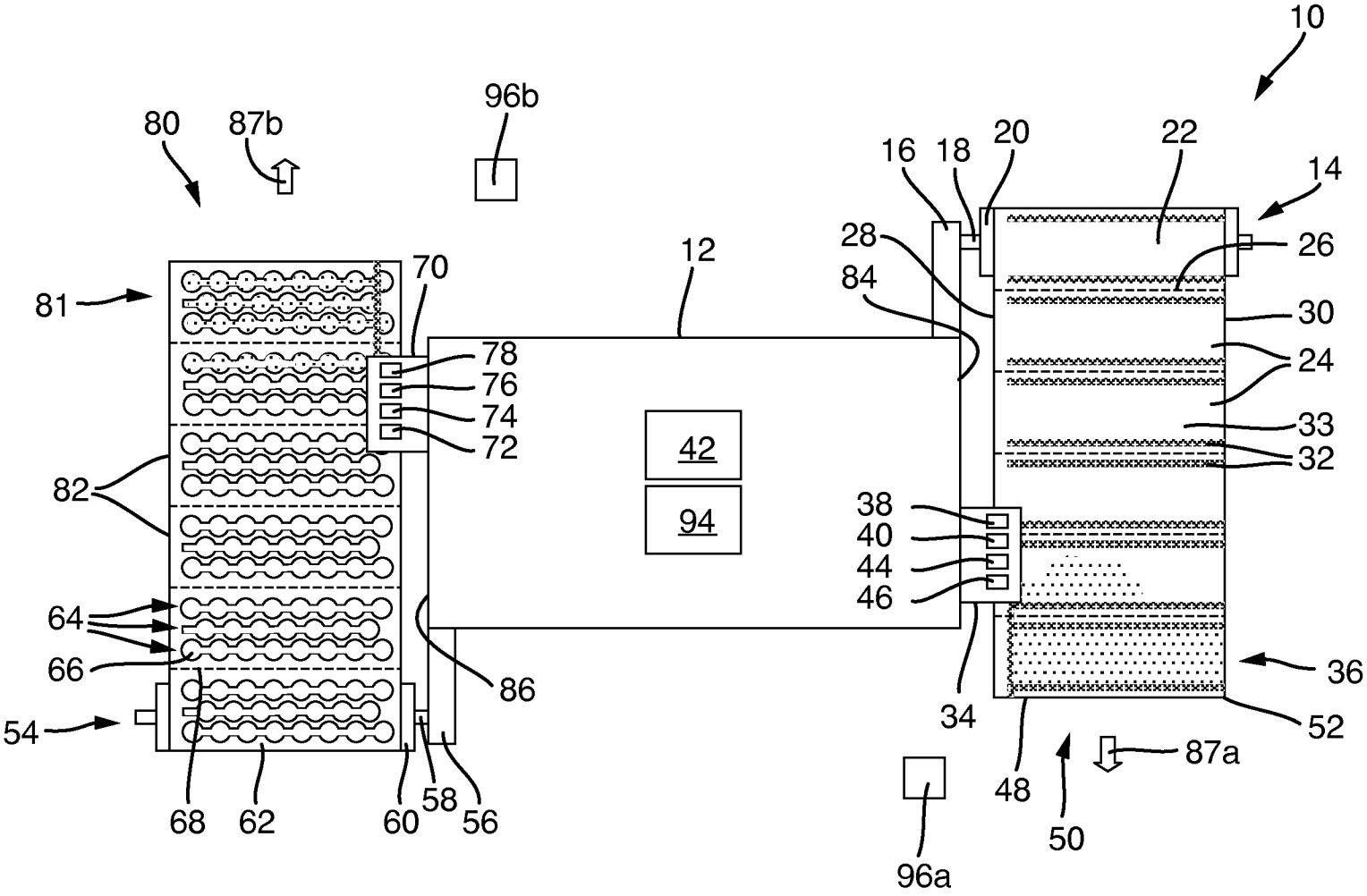
FIG. 3 is a view similar to FIG. 1 on a third embodiment of a machine for producing cushioning material.

Referring now to FIG. 3, which shows a third embodiment of a machine 10 for producing a cushioning material 36, 81, the difference with respect to the embodiment of FIG. 1 lies in the second supply assembly 54 and the second transformation assembly 70, as well as in the controlling means, as will be explained below:

Other than in FIG. 1, the second supply assembly 54 and the second transformation assembly 70 are arranged such that the second cushioning material 81 is dispensed at the second machine exit 80 in a second direction 87*b* which is opposite to the first direction 87*a* in which the first cushioning material 36 is dispensed at the first machine exit 50. Or, in other words: while the first transformation assembly 34 dispenses the first cushioning material 36 in FIG. 3 downwardly according to the first arrow 87*a*, the second transformation assembly 70 dispenses the second cushioning material 81 in FIG. 3 upwardly according to the second arrow 87*b*. By way of example, in this embodiment the guide pin of the second transformation assembly 70 which generally has been mentioned above in the context of the detailed description of the first transformation assembly 34 of FIG. 1 would be oriented in the inverse sense than the guide pin of the first transformation assembly 34.

In order to independently allow control and operation of the first transformation assembly 34 and the second transformation assembly 70, respectively, there are provided two separate foot switches 96*a* and 96*b*, the foot switch 96*a* being associated with the control of the first transformation assembly 34, and the second foot switch 96*b* being associated with the control of the second transformation assembly 70. Accordingly, the first foot switch 96*a* is arranged adjacent to the first machine exit 50, and the second foot switch 96*b* is arranged adjacent to the second machine exit 80, the first machine exit 50 being arranged diagonally opposite to the second machine exit 80. This allows independent control of both transformation assemblies 34 and 70 by two separate users at two separate packaging stations.

As has been mentioned above, the inventive machine for producing cushioning material provides a considerably increased flexibility, because either the output of cushioning material can be increased (that is at least can be doubled), or because the same machine can provide different types of cushioning material to the same packaging station, because the same machine can provide different or identical types of cushioning material to different packaging stations. Costs with respect to providing to separate machines are reduced.

Both the first transformation assembly 34 and the second transformation assembly 70 can be controlled by a common controlling means 94, it is also possible, but not shown in the drawing, to have separate controlling means for each of the transformation assemblies 34 and 70.

The invention claimed is:

1. A machine for producing cushioning material comprising:

a frame;

at least a first supply assembly mounted on said frame, the first supply assembly comprising and supplying a first web-type feed material;

at least a first transformation assembly mounted on said frame which transforms the first web-type feed material into a first cushioning material;

at least a second supply assembly mounted on said frame, the second supply assembly comprising and supplying a second web-type feed material; and at least a second transformation assembly mounted on said frame which transforms the second web-type feed material into a second cushioning material, wherein in that the first web-type feed material is different than the second web-type feed material such that at least two different types of cushioning material can be produced.

2. The machine of claim 1 wherein the first and second web-type feed materials are plastic film materials having inflatable chambers, wherein at least one of the geometry and the dimension of the inflatable chambers of the second web-type feed material is different than the geometry and dimension of the inflatable chambers of the first web-type feed material.

3. The machine of claim 2 wherein the first transformation assembly comprises:

at least a first inflation assembly for inflating the chambers within the first web-type feed material;

at least a first sealing assembly for sealing the inflated chambers after inflation; and at least a first feed assembly mounted on said frame which feeds the first web-type feed material from the first supply assembly to the first inflation assembly and the first sealing assembly; and wherein the second transformation assembly comprises:

at least a second inflation assembly for inflating the chambers within the second web-type feed material;

at least a second sealing assembly for sealing the inflated chambers after inflation; and at least a second feed assembly mounted on said frame which feeds the second web-type feed material from the second supply assembly to the second inflation assembly and the second sealing assembly.

4. The machine of claim 3 wherein the first and the second inflation assemblies comprise a common air blower.

5. The machine of claim 1 wherein the first transformation assembly is arranged on a first side of the frame and the second transformation assembly is arranged on a second side of the frame, the first and second sides being opposite with respect to each other.

6. The machine of claim 1 wherein the first transformation assembly is arranged such that the first cushioning material is dispensed in a first direction and the second transformation assembly is arranged such that the second cushioning material is dispensed in a second direction, the first and second directions being opposite with respect to each other.

7. The machine of claim 1 further comprising a selection means for selecting at least one of a first mode and a second mode, wherein in the first mode the first transformation assembly can be activated, and wherein in the second mode the second transformation assembly can be activated.

8. The machine of claim 7 further comprising means for setting an amount of cushioning material to be produced upon an activation in the first mode and in the second mode.

9. The machine of claim 8 wherein the amount in the first mode is different than the amount in the second mode.

10. The machine of claim 1 further comprising a controlling means which in a first mode controls operation of the first transformation assembly, and which in a second mode controls operation of the second transformation assembly.

11. The machine of claim 1 wherein each of the first and second transformation assemblies comprises a controlling means for controlling operation of the respective first and second transformation assemblies.

12. The machine of claim 1 wherein at least one of the first supply assembly and the second supply assembly comprises holding means for holding a roll of feed material.

13. The machine of claim 1 wherein at least one of the first supply assembly and the second supply assembly comprises storage means for storing a zig-zag-folded feed material.

14. A method of producing cushioning material comprising:

providing at least a first supply assembly mounted on a frame, the first supply assembly supplying a first type of web-type feed material;

providing at least a first transformation assembly mounted on said frame which transforms the first web-type feed material into a first type of cushioning material;

providing at least a second supply assembly mounted on said frame, the second supply assembly supplying a second type of web-type feed material;

providing at least a second transformation assembly mounted on said frame which transforms the second web-type feed material into a second type of cushioning material; and selecting whether the first type of cushioning material shall be produced using the first transformation assembly or whether the second type of cushioning material shall be produced using the second transformation assembly.

* * * * *